US009021728B1

(12) United States Patent
Kocmich, IV et al.

(10) Patent No.: US 9,021,728 B1
(45) Date of Patent: May 5, 2015

(54) FIREARM RECOIL RETURN ASSEMBLY

(71) Applicants: Edward Kocmich, IV, Keithville, LA (US); Edward Kocmich, V, Keithville, LA (US)

(72) Inventors: Edward Kocmich, IV, Keithville, LA (US); Edward Kocmich, V, Keithville, LA (US)

( * ) Notice: Subject to any disclaimer, the term of this patent is extended or adjusted under 35 U.S.C. 154(b) by 219 days.

(21) Appl. No.: 13/898,930

(22) Filed: May 21, 2013

(51) Int. Cl.
*F41A 21/00* (2006.01)
*F41A 23/04* (2006.01)

(52) U.S. Cl.
CPC ..... *F41A 23/04* (2013.01)

(58) Field of Classification Search
USPC ..... 42/1.06, 94; 89/37.03, 37.04; 248/637, 248/562
See application file for complete search history.

(56) References Cited

U.S. PATENT DOCUMENTS

| | | | | |
|---|---|---|---|---|
| 2,433,637 | A | 12/1947 | Trotter | |
| 2,439,105 | A | 4/1948 | Sanford et al. | |
| 2,679,192 | A | 5/1954 | Seeley et al. | |
| 3,418,880 | A | 12/1968 | Herlach | |
| 4,467,697 | A | 8/1984 | Witt et al. | |
| 4,503,632 | A | 3/1985 | Cuevas | |
| 6,347,568 | B1 | 2/2002 | Soulaigre | |
| 7,340,857 | B1 | 3/2008 | Bentley | |
| 8,006,426 | B1 * | 8/2011 | Carroll | 42/94 |
| 8,028,611 | B2 | 10/2011 | Loundsbury | |
| 8,201,354 | B2 | 6/2012 | Bentley | |
| 8,276,501 | B1 * | 10/2012 | Sukurlu | 89/43.01 |
| 2010/0170128 | A1 * | 7/2010 | Werner | 42/1.06 |
| 2011/0203454 | A1 * | 8/2011 | Schoning-Olsen et al. | 89/44.01 |
| 2014/0059908 | A1 * | 3/2014 | Dextraze et al. | 42/1.06 |

* cited by examiner

*Primary Examiner* — J. Woodrow Eldred
(74) *Attorney, Agent, or Firm* — R. Keith Harrison

(57) ABSTRACT

A firearm recoil return assembly includes an assembly housing adapted for attachment to the firearm; an accessory attachment rail carried by the assembly housing and adapted for attachment to the firearm support, the assembly housing positional in and between a firearm pre-recoil position and a firearm recoil position on the accessory attachment rail; and a housing return mechanism carried by the assembly housing and engaging the accessory attachment rail, the housing return mechanism normally biasing the assembly housing in the firearm pre-recoil position.

20 Claims, 7 Drawing Sheets

FIREARM RECOIL RETURN ASSEMBLY

FIELD

Illustrative embodiments of the disclosure generally relate to firearms. More particularly, illustrative embodiments of the disclosure relate to a firearm recoil return assembly which automatically returns a firearm to a firearm pro-recoil position after firing.

BACKGROUND

Firearms including rifles, shotguns and pistols commonly recoil in a backward motion upon firing due to ejection of a projectile from the firearm. In applications in which the firearm is supported by a bipod, tripod or other firearm support, recoil may necessitate manual forward repositioning of the firearm and support to a firearm pre-recoil position preparatory to firing the next shot. Therefore, a firearm recoil return assembly which automatically returns a firearm to a firearm pre-recoil position after firing may be desirable for some applications.

SUMMARY

Illustrative embodiments of the disclosure are generally directed to a firearm recoil return assembly for attaching a firearm to a firearm support. An illustrative embodiment of the firearm recoil return assembly includes an assembly housing adapted for attachment to the firearm; an accessory attachment rail carried by the assembly housing and adapted for attachment to the firearm support, the assembly housing positional in and between a firearm pre-recoil position and a firearm recoil position on the accessory attachment rail; and a housing return mechanism carried by the assembly housing and engaging the accessory attachment rail, the housing return mechanism normally biasing the assembly housing in the firearm pre-recoil position.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. As used heroin, relative terms such as "upper", "lower", "front" and "rear" are intended to be used in an illustrative and not a limiting sense. In some applications, for example, those elements which are identified as "lower" may be located in other spatial relationships relative to those elements which are identified as "lower" in the following detailed description.

Figure 15:
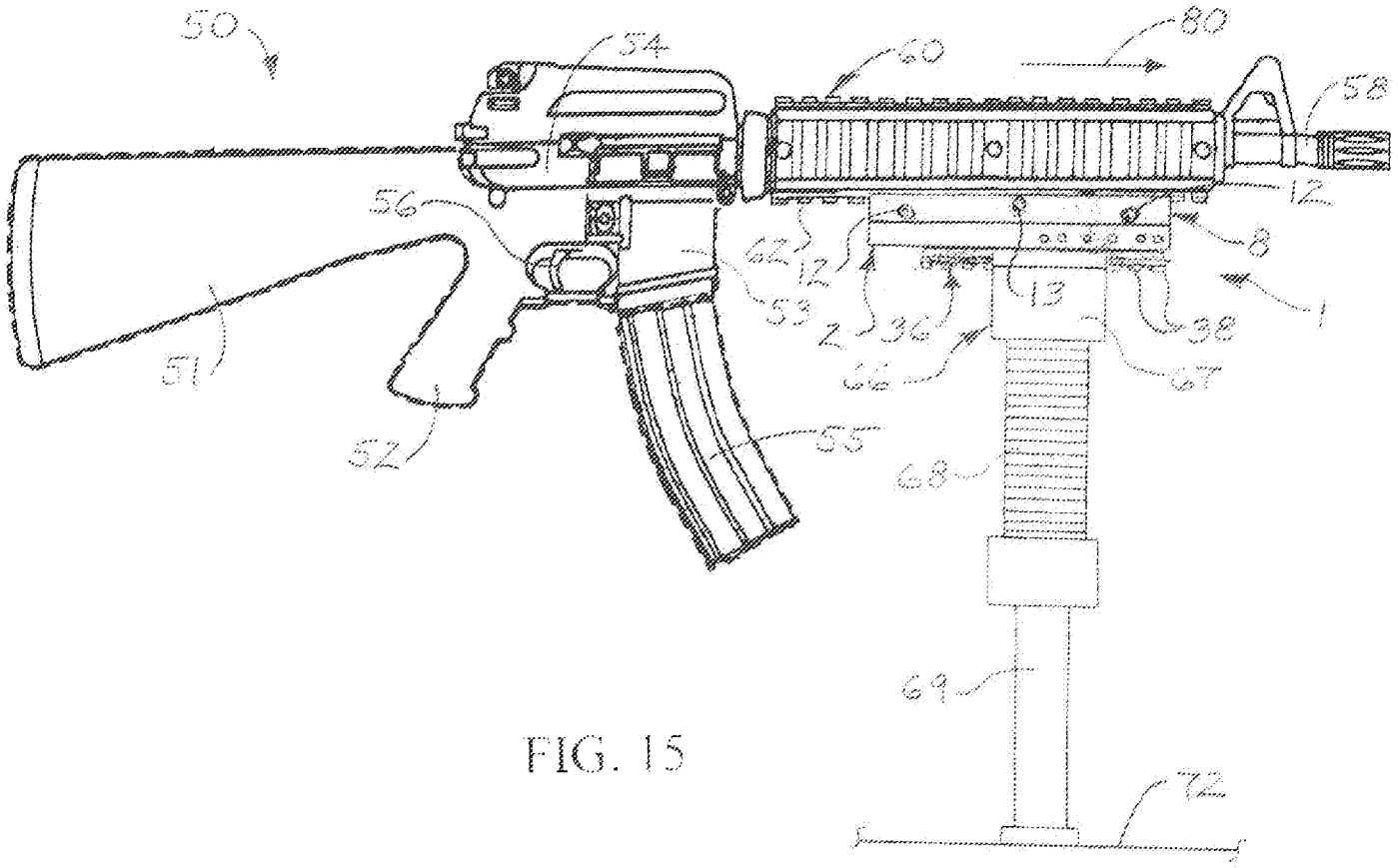
FIG. 15 is a side view of the firearm with the illustrative firearm recoil return assembly attached to the accessory rail assembly and the firearm support attached to the firearm recoil return assembly, with the firearm and the assembly disposed in a firearm pre-recoil position prior to firing of the firearm.
Figure 16:
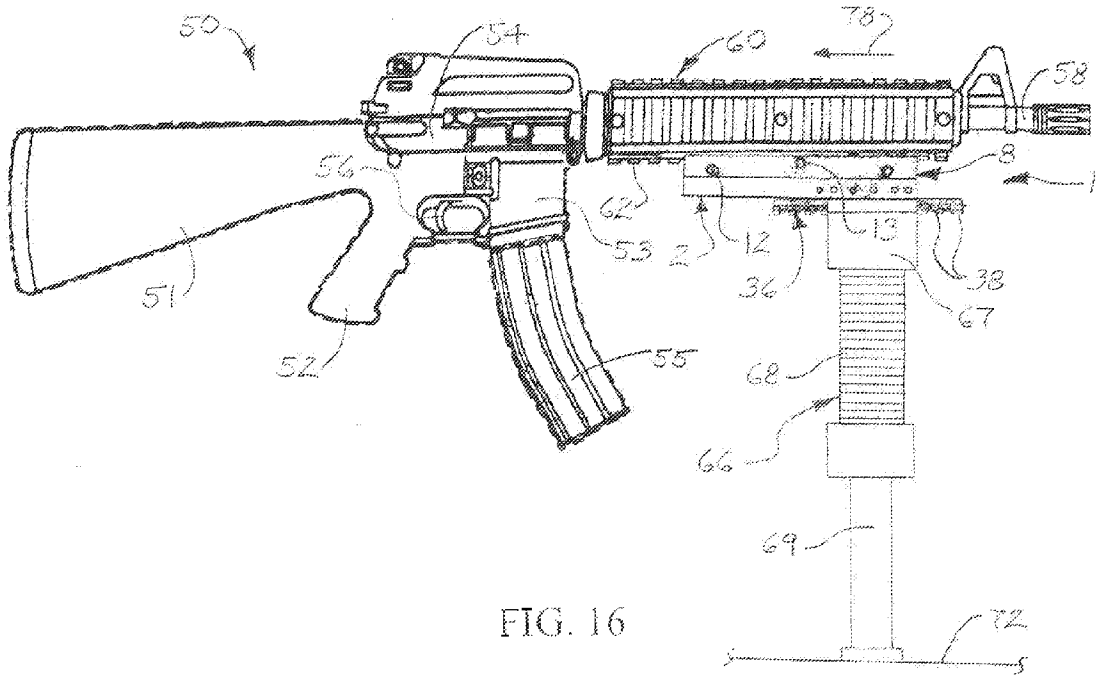
FIG. 16 is a side view of the firearm with the illustrative firearm recoil return assembly attached to the accessory rail assembly and the firearm support attached to the firearm recoil return assembly, with the firearm and the assembly disposed in a firearm recoil position upon firing of the firearm.

Referring initially to FIGS. 15 and 16 of the drawings, an illustrative embodiment of the firearm recoil return assembly is generally indicated by reference numeral 1. In exemplary application, which will be hereinafter described, the firearm recoil return assembly 1 is adapted for attachment to a firearm 50 via an accessory rail assembly 60 provided on the barrel 58 of the firearm 50. The firearm recoil return assembly 1 is further adapted for attachment to a stationary firearm support 66 such as a bipod or tripod, for example and without limitation, which is adapted to rest on the ground or other support surface 72 and support the firearm 50. Upon firing and consequent recoil of the firearm 50, the firearm recoil return assembly 1 is adapted to automatically return the firearm 50 from a firearm recoil position (FIG. 16) to a firearm pre-recoil position (FIG. 15) relative to the firearm support 66 preparatory to the next firing of the firearm 50. The various components of the firearm recoil return assembly 1 can be fabricated of aluminum, steel, carbon composite and/or other suitable materials using casting, molding, machining and/or alternative manufacturing techniques known by those skilled in the art.

Referring next to FIGS. 1-13 of the drawings, the firearm recoil return assembly 1 includes an assembly housing 2. The assembly housing 2 may be generally elongated with a front housing end 2*a*, a rear housing end 2*b* and an upper housing surface 7 and a lower housing surface 11 which extend between the front housing end 2*a* and the rear housing end 2*b*. The assembly housing 2 is adapted to interface with a bottom accessory rail 62 of the accessory rail assembly 60 (FIG. 13) such as in a manner which will be hereinafter described. A firearm attachment rail slot 3 may extend along the upper housing surface 7 from the front housing end 2*a* to the rear housing end 2*b* of the assembly housing 2. The firearm attachment rail slot 3 may be sized and configured to mate in sliding relationship with the bottom accessory rail 62 on the accessory rail assembly 60 of the firearm 50. The firearm attachment rail slot 3 may be configured to mate with any type of accessory rail assembly 60 which is known by those skilled in the art, such as a conventional Weaver rail mount or Picatinny mount (such as a mil-standard 1913 rail), for example and without limitation. In some applications, the accessory rail assembly 60 may include a conventional quad rail assembly having a top accessory rail 61, the bottom accessory rail 62 and side accessory rails (not illustrated).

In some embodiments, the firearm attachment rail slot 3 may include a fixed slot flange 4 having a fixed slot flange edge 5, an adjustable slot flange 8 having an adjustable slot flange edge 10 facing the fixed slot flange edge 5 of the fixed slot flange 4 and a generally flat or planar slot bottom 6 extending between the fixed slot flange 4 and the adjustable slot flange 8. As illustrated in FIGS. 1-4, the adjustable slot flange 8 may further include an adjustable slot flange base 9 which interfaces with a companion flange base slot 14 in the assembly housing 2. In alternative embodiments, the adjustable slot flange 8 may be fixedly attached to the assembly housing 2 in fixed relationship to the fixed slot flange 4.

The adjustable slot flange 8 may be attached to the assembly housing 2 according to any suitable adjustable attachment mechanism which is known by those skilled in the art. In some embodiments, multiple adjustable slot flange fasteners 12 may attach the adjustable slot flange 8 to the assembly housing 2. Accordingly, the adjustable slot flange fasteners 12 can be selectively threaded or unthreaded as deemed necessary to achieve a selected width of the firearm attachment rail slot 3 which accommodates a corresponding width of the bottom accessory rail 62 on the accessory rail assembly 60 of the firearm 50.

An accessory attachment rail 36 is adapted to slidably interface with the assembly housing 2. The accessory attachment rail 36 is adapted for attachment to the firearm support 66 (FIG. 15) such as in a manner which will be hereinafter described. In some embodiments, the accessory attachment rail 36 may include an elongated accessory attachment rail base 37. Two elongated rows of multiple, adjacent, spaced-apart rail teeth 38 may extend at an angle from opposite sides of the rail base 37. Rail notches 39 may be formed by and between the adjacent rail teeth 38 for purposes which will be hereinafter described. It will be recognized and understood by those skilled in the art that the accessory attachment rail 36 may have any design which facilitates attachment of the assembly housing 2 in sliding relationship to the firearm support 66.

Figure 11:
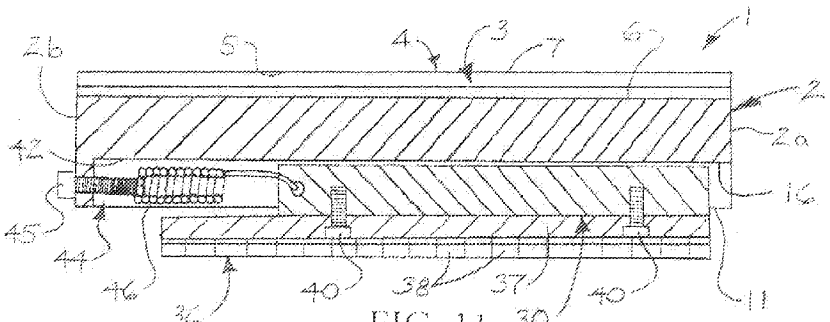
FIG. 11 is a longitudinal sectional view, taken along section lines 11-11 in FIG. 6.

The accessory attachment rail 36 may be slidably mourned to the assembly housing 2 at the lower housing surface 11 according to any technique which is known by those skilled in the art and is suitable for the purpose. For example and without limitation, in some embodiments, a housing mount rail 30 may extend along at least a portion of the accessory attachment rail 36. A slide rail slot 16 may extend through the assembly housing 2 from the front housing end 2*a* toward the rear housing end 2*b* along at least a portion of the lower housing surface 11. The housing mount rail 30 may be adapted to slidably engage the slide rail slot 16 such as in a manner which will be hereinafter described. Accordingly, the assembly housing 2 is slidable relative to the accessory attachment rail 36 between a firearm pre-recoil position illustrated in FIG. 6, in which the accessory attachment rail 36 may be generally flush with the front assembly housing end 2*a*, and a firearm recoil position illustrated in FIG. 7, in which the accessory attachment rail 36 protrudes beyond the front housing end 2*a* of the assembly housing 2. In some embodiments, the housing mount rail 30 and the accessory attachment rail 36 may be fabricated separately and the accessory attachment rail 36 may be attached to the housing mount rail 30 using accessory attachment rail fasteners 40, as illustrated in FIG. 11, and/or other suitable attachment technique. In other embodiments, the accessory attachment rail 36 may be fabricated in one piece with the housing mount rail 30 using molding, casting and/or other fabrication techniques known by those skilled in the art.

Figure 8:
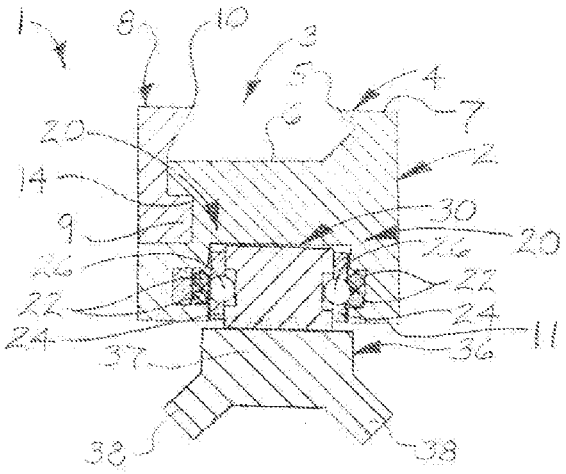
FIG. 8 is a cross-sectional view, taken along section lines 8-8 in FIG. 6.
Figure 9:
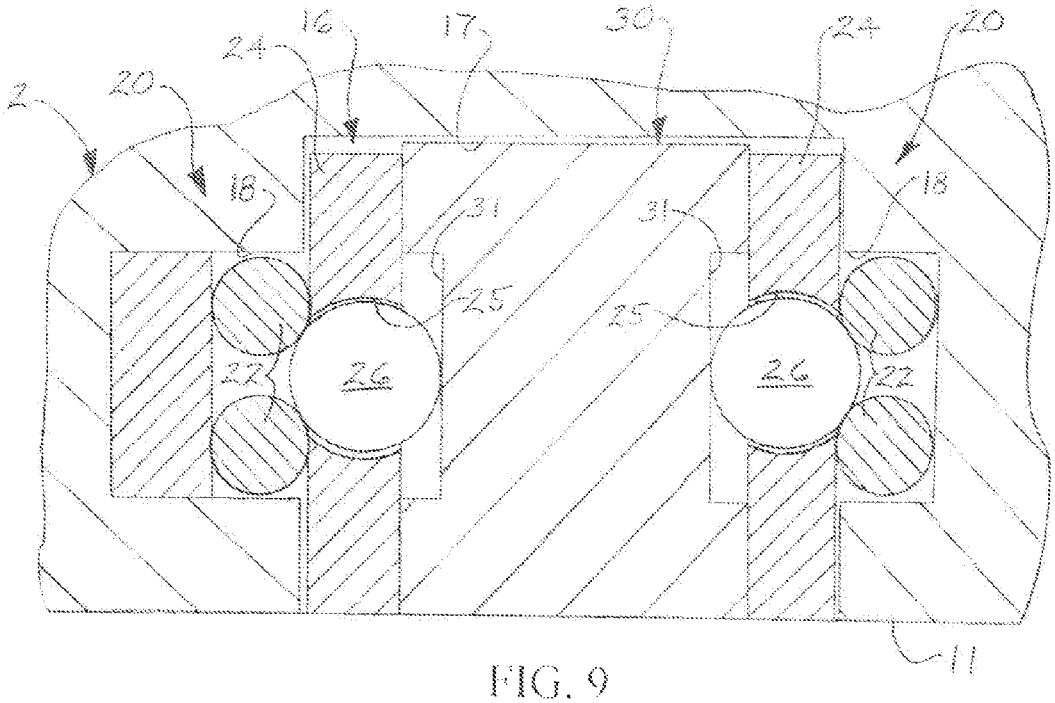
FIG. 9 is an enlarged cross-sectional view of the firearm recoil return assembly taken along section lines 8-8 in FIG. 6.
Figure 10:
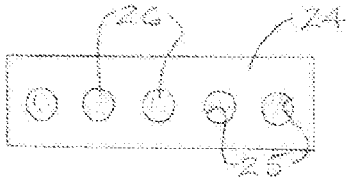
FIG. 10 is a side view of an exemplary bearing guide.

As illustrated in FIGS. 8 and 9, in cross-section, the slide rail slot 16 (FIG. 9) may include a main slot portion 17 and a pair of bearing runner slot portions 18 which extend along and in communication with opposite sides of the main slot portion 17. At least one ball bearing assembly 20 may be provided between the housing mount rail 30 and the interior surface of the slide rail slot 16. In some embodiments, a pair of ball bearing assemblies 20 may be provided between the housing mount rail 30 and the interior surfaces of the slide rail slot 16 on respective sides of the housing mount rail 30, as illustrated. Each ball bearing assembly 20 may include a pair of parallel, adjacent ball bearing runners 22 which extend along and within the corresponding bearing runner slot portion 18. At least one bearing guide 24 may be disposed within the main slot portion 17 of the slide rail slot 16 and extending along and adjacent to the bearing runner slot portion 18. Multiple ball bearing openings 25 may extend through each bearing guide 24. A ball bearing 26 may be disposed within each ball bearing opening 25. A pair of ball bearing grooves 31 may be provided in opposite sides of the housing mount rail 30. Accordingly, the ball bearings 26 in the respective ball bearing openings 25 of each bearing guide 24 may protrude against the corresponding pair of ball bearing runners 22 and into the ball bearing groove 31 in the corresponding side of the housing mount rail 30 to slidably mount the housing mount rail 30 in the slide rail slot 16. Therefore, the ball bearings 26 of each ball bearing assembly 20 provide a smooth interface between the housing mount rail 30 and the interior surfaces of the slide rail slot 16 as the assembly housing 2 slides between the firearm pre-recoil and firearm recoil positions in operation of the firearm recoil return assembly 1.

Figure 2:
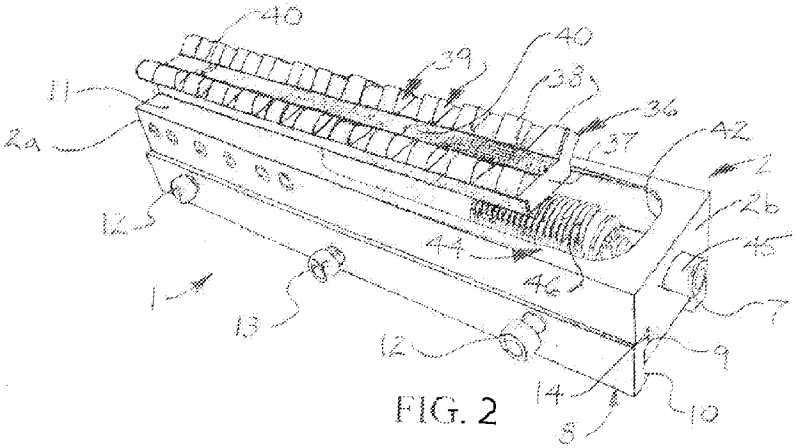
FIG. 2 is a bottom perspective view of an illustrative firearm recoil return assembly.
Figure 4:
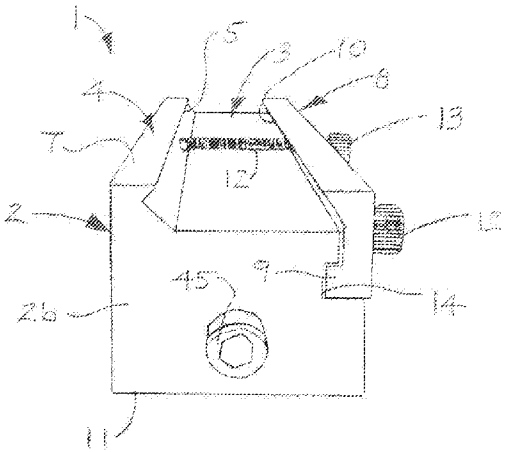
FIG. 4 is a rear view of an illustrative firearm recoil return assembly.
Figure 1:
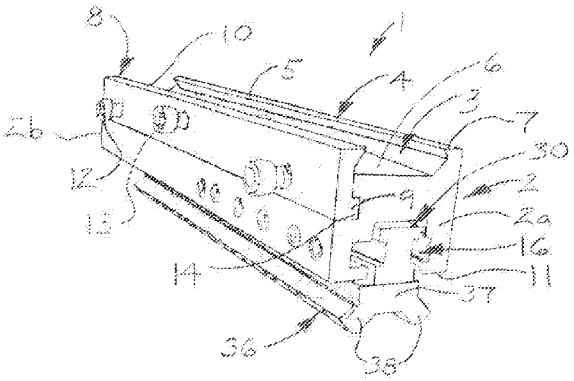
FIG. 1 is a front perspective view of an illustrative embodiment of the firearm recoil return assembly.
Figure 3:
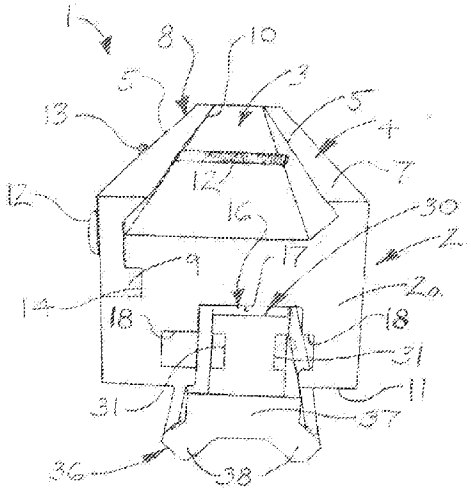
FIG. 3 is a front view of an illustrative firearm recoil return assembly.
Figure 5:
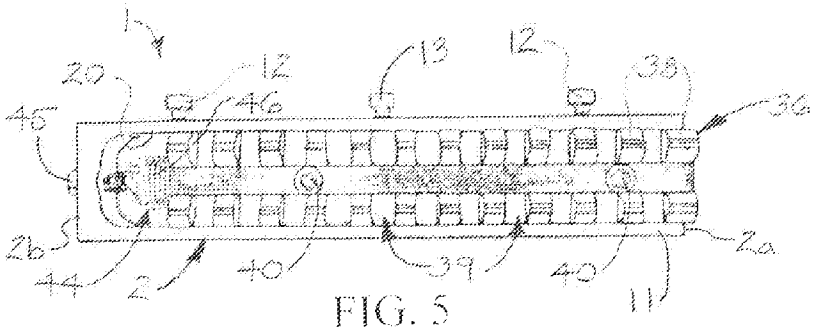
FIG. 5 is a bottom view of an illustrative firearm recoil return assembly.
Figure 6:
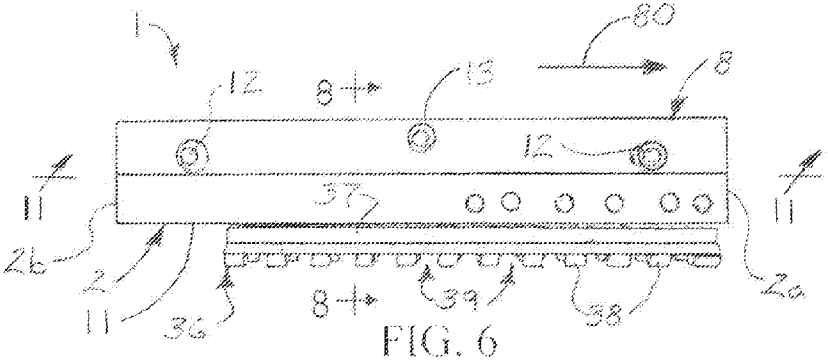
FIG. 6 is a side view of an illustrative firearm recoil return assembly, with the assembly deployed in a firearm pre-recoil position.
Figure 7:
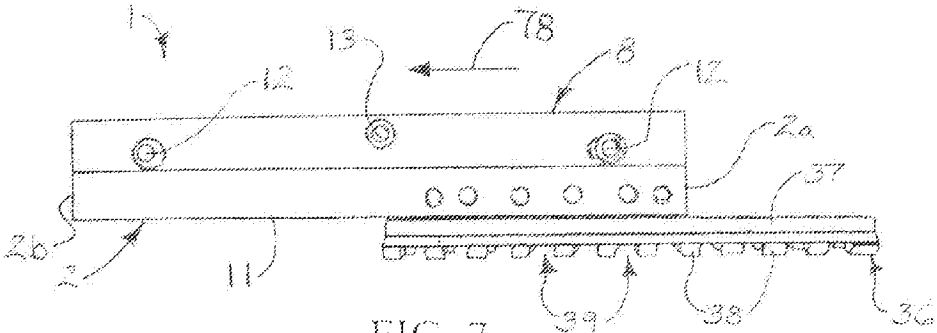
FIG. 7 is a side view of an illustrative firearm recoil return assembly, with the assembly deployed in a firearm recoil position.
Figure 12:
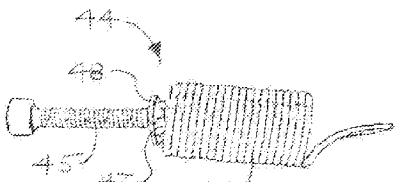
FIG. 12 is a side view of an exemplary recoil return mechanism.

As illustrated in FIGS. 2, 11 and 12, a housing return mechanism 44 is provided on the assembly housing 2 and engages the housing mount rail 30. The housing return mechanism 44 normally biases the assembly housing 2 with a return force 80 (FIG. 6) in the firearm pre-recoil position relative to the accessory attachment rail 36, as illustrated in FIG. 6. Upon firing of the firearm 50 (FIG. 16), the recoiling firearm 50 applies a linear firearm recoil force 78 (FIG. 7) to the attached assembly housing 2. Therefore, the assembly housing 2 slides along the stationary accessory attachment rail 36, against the biasing return force 80 which is imparted by the housing return mechanism 44, from the firearm pre-recoil position illustrated in FIG. 6 to the firearm recoil position illustrated in FIG. 7. After firing of the firearm 50, the return force 80 imparted by the housing return mechanism 44 automatically slides the assembly housing 2 along the accessory attachment rail 36 back to the firearm pre-recoil position.

In some embodiments, a housing return mechanism cavity 42 may be provided in the lower housing surface 11 of the assembly housing 2 and may communicate with the slide rail slot 16. The housing return mechanism 44 may be disposed inside the housing return mechanism cavity 42. As further illustrated in FIGS. 2, 11 and 12, in some embodiments, the housing return mechanism 44 may include a spring anchor bolt 45 which is anchored in the housing return mechanism cavity 42. At least one coiled return spring 46 is secured on the spring anchor bolt 45 such as by using a bolt 47 and a washer 48. As illustrated in FIG. 11, the return spring 46 is attached to the housing mount rail 30. Accordingly, the return spring 45 normally remains in a contracted configuration and maintains the assembly housing 2 in the firearm pre-recoil position relative to the accessory attachment rail 36, as illustrated in FIGS. 6 and 11. It will be recognized and understood by those skilled in the art that the housing return mechanism 44 may include any mechanism or technique, other than or in addition to the return spring 46, which is known by those skilled in the art and suitable for the purpose of imparting the return force 80 and normally biasing the assembly housing 2 in the firearm pre-recoil position illustrated in FIG. 6.

Referring next to FIGS. 13-19 of the drawings, in exemplary application, the firearm recoil return assembly 1 is attached to the accessory rail assembly 60 on the firearm 50. In some applications, the firearm 50 may be a semi-automatic rifle having a conventional design with a stock 51, a rear grip 52, a magazine receiver 53 in front of the rear grip 52, a trigger 56 between the rear grip 52 and the magazine receiver 53, a chamber 54 above the magazine receiver 53 and a barrel 58 extending forwardly from the chamber 33. A detachable magazine 55 which contains a supply of spring-loaded rounds (not illustrated) may interface with the magazine receiver 53 to individually and sequentially push the rounds into the chamber 54 as the firearm 50 is fired, typically in the conventional manner.

Figure 13:
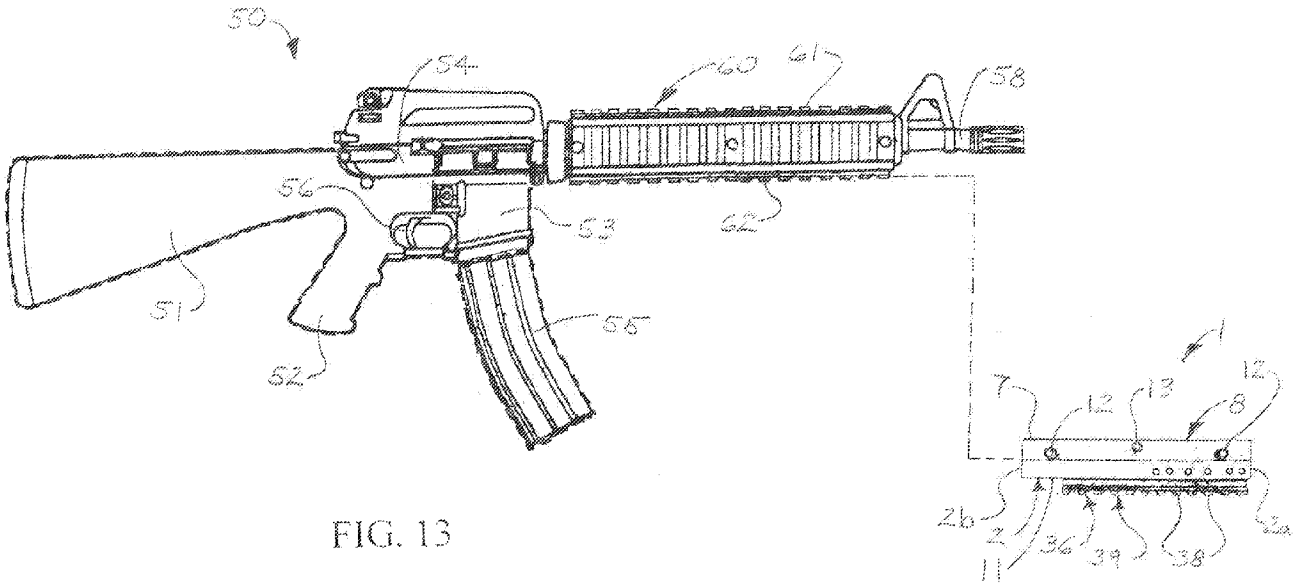
FIG. 13 is a side view of a firearm, more particularly illustrating exemplary attachment of an illustrative firearm recoil return assembly to an accessory rail assembly on the firearm.
Figure 14:
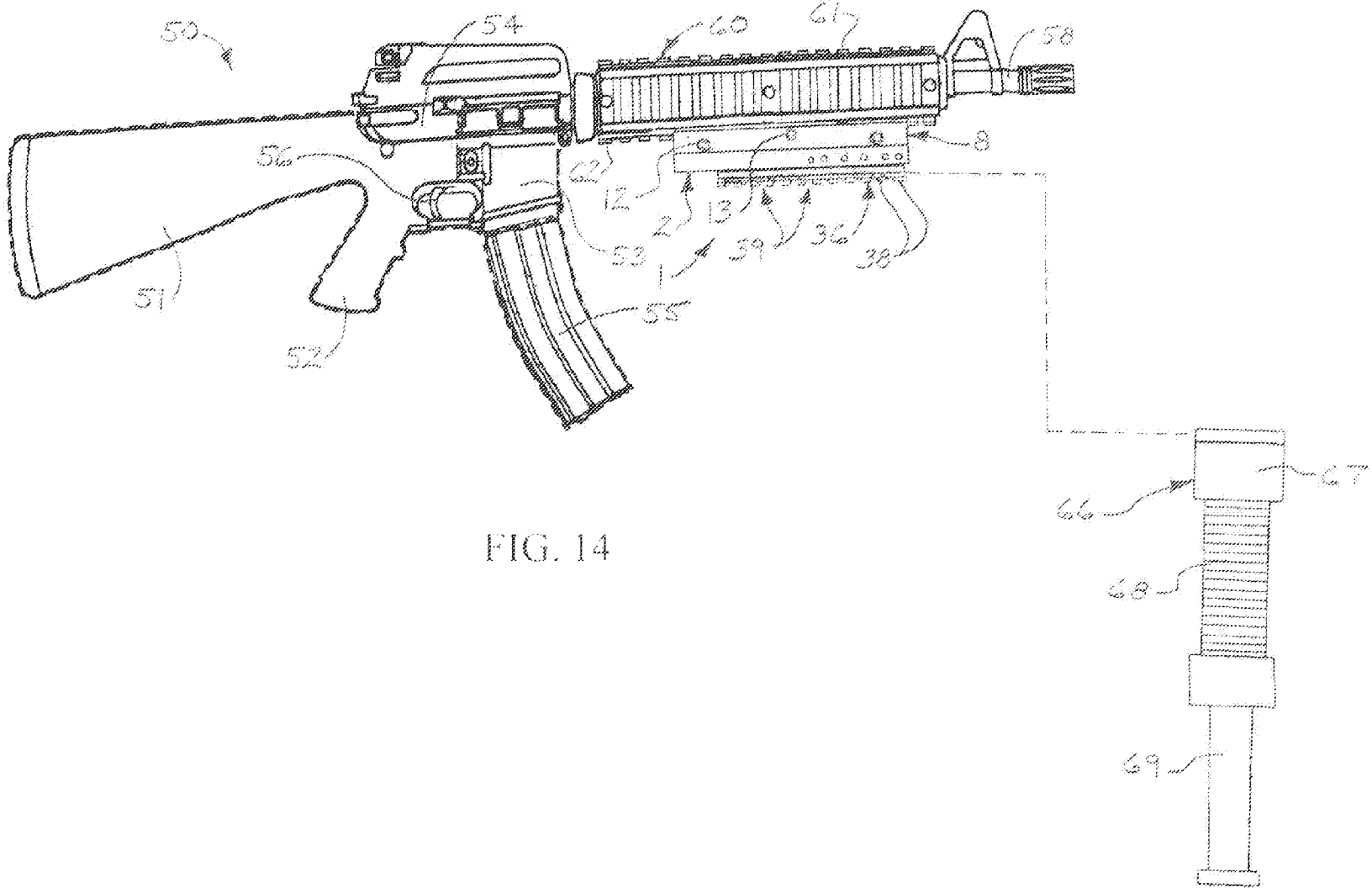
FIG. 14 is a side view of the firearm, with the illustrative firearm recoil return assembly attached to the accessory rail assembly on the firearm and more particularly illustrating exemplary attachment of a firearm support to the firearm recoil return assembly.

As illustrated in FIGS. 13 and 14, the assembly housing 2 is initially attached to the bottom accessory rail 62 of the accessory rail assembly 60 by slidably inserting the bottom accessory rail 62 into the firearm attachment rail slot 3 of the assembly housing 2. In some embodiments, the adjustable slot flange fasteners 12 can be selectively unthreaded or threaded to vary the distance between the adjustable slot flange 8 (FIG. 3) and the fixed slot flange 4 and accommodate the width of the bottom accessory rail 62. After adjustment, the adjustable slot flange fasteners 12 may be tightened to secure the adjustable slot flange 8 against the bottom accessory rail 62. At least one housing fastener 13 may be used to secure the assembly housing 2 in position on the bottom accessory rail 62.

As illustrated in FIGS. 14 and 15, the firearm support 66 is attached to the accessory attachment rail 36 of the firearm recoil return assembly 1. The firearm support 66 may have a conventional bipod or tripod design with a firearm support bracket 67 adapted for sliding engagement with and attachment to the accessory attachment rail 36, a firearm support leg 68 winch extends from the firearm support bracket 67 and diverging firearm support feet 69 (one of which is illustrated) extending downwardly from the firearm support leg 68. The firearm support bracket 67 of the firearm support 66 may be secured to the accessory attachment rail 36 using suitable fasteners (not illustrated) and/or other technique known by those skilled in the art.

As illustrated in FIG. 15, the firearm support feet 69 of the firearm support 66 are placed on the ground or other substantially level support surface 72. Accordingly, the firearm support 66 and the attached accessory attachment rail 36 of the firearm recoil return assembly 1 remain stationary with the ground or other support surface 72. The assembly housing 2, attached to the firearm 50 via the accessory rail assembly 60, slides relative to the accessory attachment rail 36. The housing return mechanism 44 (FIG. 11) imparts the return force 80 which normally biases and maintains the assembly housing 2 of the firearm recoil return assembly 1, and the attached firearm 50, in the firearm pre-recoil position on the accessory attachment rail 36, as illustrated in FIG. 15.

An operator (not illustrated) of the firearm 50 places the stock 51 against the shoulder and places a finger 74 (FIGS. 17-19) against the trigger 56 typically in the conventional manner. As the firearm operator squeezes the trigger 56, a projectile (not illustrated) is fired from the chamber 54 and is ejected from the barrel 58 of the firearm 50. The exit force of the ejecting projectile imparts a rearward firearm recoil force 78 (FIG. 16) against the firearm 50, causing a corresponding rearward recoil movement of the firearm 50. Simultaneously, the assembly housing 2 of the firearm recoil return assembly 1, attached to the bottom accessory rail 62 on the firearm 50, moves rearwardly with the recoiling firearm 50 whereas the accessory attachment rail 36 of the firearm recoil return assembly 1 remains stationary with the firearm support 66. Consequently, the return spring 46 of the housing return mechanism 44 is stretched and tensioned between the rearwardly-moving assembly housing 2 and the stationary housing mount rail 30 and accessory attachment rail 36. The return spring 46 immediately contracts, pulls and returns the assembly housing 2, with the firearm 50, along the housing mount rail 30 back to the firearm pre-recoil position of FIG. 15.

It will be appreciated by those skilled in the art that the biasing return force 80 which is imparted by the housing return mechanism 40 against the assembly housing 2 and the attached firearm 50 automatically returns the firearm 50 to the firearm pre-recoil position after each firing of the firearm 50. Therefore, the firearm support 60 remains stationary on the ground or other support surface 72. Accordingly, the need to manually reposition the firearm support 66 on the ground or other support surface 72 for each successive shot is eliminated.

Figure 18:
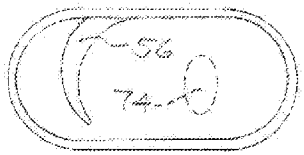
FIG. 18 is a side view of the firearm trigger, more particularly illustrating a position of the trigger relative to the firearm operator's finger upon firing and recoil of the firearm.
Figure 19:
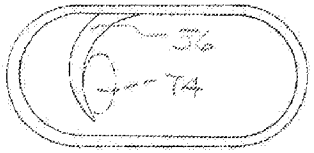
FIG. 19 is a side view of the firearm trigger, more particularly illustrating a firearm pre-recoil position of the trigger relative to the firearm operator's finger after firing and return of the firearm to the firearm pre-recoil position.
Figure 17:
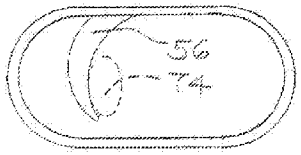
FIG. 17 is a side view of a trigger on the firearm, more particularly illustrating a firearm pre-recoil position of the trigger relative to a firearm operator's finger prior to firing and recoil of the firearm.

The initial firearm pre-recoil position of the trigger 56 relative to the finger 74 of the firearm operator is illustrated in FIG. 17. Upon firing of the firearm 50, the rearward recoil movement of the firearm 50 positions the trigger 56 rearwardly of the firearm operator's finger 74, as illustrated in FIG. 18. The firearm recoil return assembly 1 immediately returns the firearm 50 and the trigger 56 to the forward firearm pre-recoil position illustrated in FIG. 19, eliminating the need for the firearm operator to reposition his or her finger 74 against the trigger 56 for each successive shot. This expedient optimally repositions the trigger 56 against the firearm operator's finger 74 preparatory to each shot, eliminating the need for the firearm operator to locate the trigger 56 with his or her finger 74 and decreasing the time interval between each shot.

While illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A firearm recoil return assembly for attaching a firearm to a firearm support, comprising:

an assembly housing adapted for attachment to the firearm;

an accessory attachment rail carried by the assembly housing and adapted for attachment to the firearm support, the assembly housing configured to move from a first position to a second position on the accessory attachment rail as the firearm moves from a pre-recoil position to a recoil position during firing of the firearm; and a housing return mechanism carried by the assembly housing and engaging the accessory attachment rail, the housing return mechanism normally biasing the assembly housing in the first position.

2. The firearm recoil return assembly of claim 1 further comprising a firearm attachment rail slot in the assembly housing, the firearm attachment rail slot adapted to facilitate attachment of the assembly housing to the firearm.

3. The firearm recoil return assembly of claim 2 wherein the firearm attachment rail slot comprises a first slot flange and a second slot flange disposed in spaced-apart relationship to each other.

4. The firearm recoil return assembly of claim 3 wherein the first slot flange comprises a fixed slot flange and the second slot flange comprises an adjustable slot flange adjustable in spacing relative to the fixed slot flange.

5. The firearm recoil return assembly of claim 1 further comprising a slide rail slot in the assembly housing, and wherein the accessory attachment rail interfaces with the slide rail slot in sliding relationship.

6. The firearm recoil return assembly of claim 5 further comprising a housing mount rail slidably disposed in the slide rail slot, and wherein the accessory attachment rail is carried by the housing mount rail.

7. The firearm recoil return assembly of claim 6 further comprising at least one ball bearing assembly in the slide rail slot between the housing mount rail and the assembly housing.

8. The firearm recoil return assembly of claim 1 wherein the housing return mechanism comprises a coiled return spring.

9. A firearm recoil return assembly for attaching a firearm having an accessory rail to a firearm support, comprising:

an elongated assembly housing having a first housing end, a second housing end opposite the first housing end and opposite first and second housing surfaces extending between the first housing end and the second housing end, the first housing surface adapted for attachment to the accessory rail on the firearm;

an accessory attachment rail carried by the second housing surface of the assembly housing and adapted for attachment to the firearm support, the assembly housing configured to move from a first position to a second position on the accessory attachment rail as the firearm moves from a pre-recoil position to a recoil position during firing of the firearm; and a housing return mechanism carried by the assembly housing and engaging the accessory attachment rail, the housing return mechanism normally biasing the assembly housing in the first position.

10. The firearm recoil return assembly of claim 9 further comprising a firearm attachment rail slot in the first housing surface of the assembly housing, the firearm attachment rail slot adapted to facilitate attachment of the assembly housing to the accessory rail on the firearm.

11. The firearm recoil return assembly of claim 10 wherein the firearm attachment rail slot comprises a first slot flange and a second slot flange disposed in spaced-apart relationship to each other.

12. The firearm recoil return assembly of claim 11 wherein the first slot flange comprises a fixed slot flange and the second slot flange comprises an adjustable slot flange adjustable in spacing relative to the fixed slot flange.

13. The firearm recoil return assembly of claim 9 further comprising a slide rail slot in the second housing surface of the assembly housing, and wherein the accessory attachment rail slidably engages the slide rail slot.

14. The firearm recoil return assembly of claim 13 further comprising a housing mount rail slidably disposed in the slide rail slot, and wherein the accessory attachment rail is carried by the housing mount rail.

15. The firearm recoil return assembly of claim 14 further comprising at least one ball bearing assembly in the slide rail slot between the housing mount rail and the assembly housing.

16. The firearm recoil return assembly of claim 9 wherein the housing return mechanism comprises a coiled return spring.

17. A firearm recoil return assembly for attaching a firearm having an accessory rail to a firearm support having a firearm support bracket, comprising:

an elongated assembly housing including:

a first housing end;

a second housing end opposite the first housing end;

a first housing surface extending between the first housing end and the second housing end;

a second housing surface extending between the first housing end and the second housing end opposite the first housing surface;

a firearm attachment rail slot in the first housing surface, the firearm attachment rail slot adapted for attachment to the accessory rail on the firearm; and a slide rail slot in the second housing surface;

an elongated housing mount rail slidably disposed in the slide rail slot;

an elongated accessory attachment rail carried by the housing mount rail and adapted for attachment to the firearm support bracket on the firearm support, the assembly housing configured to move from a first position to a second position on the accessory attachment rail as the firearm moves from a pre-recoil position to a recoil position during firing of the firearm; and a housing return mechanism carried by the assembly housing and engaging the accessory attachment rail, the housing return mechanism normally biasing the assembly housing in the first position.

18. The firearm recoil return assembly of claim 17 wherein the firearm attachment rail slot comprises a first slot flange and a second slot flange disposed in spaced-apart relationship to each other.

19. The firearm recoil return assembly of claim 18 wherein the first slot flange comprises a fixed slot flange and the second slot flange comprises an adjustable slot flange adjustable in spacing relative to the fixed slot flange.

20. The firearm recoil return assembly of claim 17 wherein the housing return mechanism comprises a coiled return spring.

* * * * *